US005826499A

United States Patent [19]

Bullington

[11] Patent Number: 5,826,499

[45] Date of Patent: Oct. 27, 1998

[54] BALING AND STRAPPING MACHINE WITH STRAP CAPTURING AND DEFLECTION APPARATUS AND METHOD THEREFOR

[75] Inventor: Robert E. Bullington, Lake Zurich, Ill.

[73] Assignee: Illinois Tool Works Inc., Glenview, Ill.

[21] Appl. No.: 891,889

[22] Filed: Jul. 14, 1997

[51] Int. Cl.[6] ..... B65B 13/06

[52] U.S. Cl. ..... 100/3; 100/26

[58] Field of Search ..... 100/2, 3, 8, 25, 100/26; 53/399, 529, 438, 589

[56] References Cited

U.S. PATENT DOCUMENTS

| | | | |
|---|---|---|---|
| 3,475,879 | 11/1969 | Merkel et al. | 100/26 |
| 3,521,550 | 7/1970 | Van Doorn et al. | 100/26 |
| 3,525,192 | 8/1970 | Merkel et al. | 100/25 |
| 3,541,948 | 11/1970 | Sauer . | |
| 3,602,133 | 8/1971 | Neitzel et al. | 100/26 |
| 3,834,297 | 9/1974 | Huson | 100/26 |
| 3,899,963 | 8/1975 | Tremper . | |
| 3,916,778 | 11/1975 | Van Doorn et al. | 100/26 |
| 4,106,403 | 8/1978 | Sutehall . | |
| 4,256,032 | 3/1981 | Davis . | |
| 4,324,176 | 4/1982 | McCormick . | |
| 4,438,689 | 3/1984 | Simich . | |
| 4,566,378 | 1/1986 | Fleissner | 100/26 |
| 4,611,534 | 9/1986 | Kudlicka et al. | 100/26 |
| 4,823,686 | 4/1989 | Fleissner | 100/26 |
| 5,200,269 | 4/1993 | Lukhard et al. . | |
| 5,355,786 | 10/1994 | Tipton et al. . | |
| 5,379,687 | 1/1995 | Moseley . | |
| 5,463,846 | 11/1995 | Gambetti | 53/589 |
| 5,546,855 | 8/1996 | Van Doorn et al. . | |

FOREIGN PATENT DOCUMENTS

| | | | |
|---|---|---|---|
| 4-142217 | 5/1992 | Japan | 53/589 |
| 5-294318 | 11/1993 | Japan | 53/589 |
| 89/12576 | 12/1989 | WIPO | 100/26 |

*Primary Examiner*—Stephen F. Gerrity

[57] ABSTRACT

A method and apparatus for capturing and deflecting strap applied about a load in a baling and strapping machine having a strap chute portion, a movable platen with a range of variable positioning, a channel with a strap outlet disposed through the movable platen, wherein the channel is generally non-parallel to the strap chute portion. The apparatus includes generally a plurality of at least two strap inlet passages, each strap inlet passage having a strap entry and a strap exit, and a common strap outlet passage having a strap exit coupled to the strap chute portion, wherein the strap exit of each strap inlet passage is coupled to the strap outlet passage. The plurality of strap inlet passages are arranged at an angle relative to the channel and adjacent the movable platen along the range of variable positioning thereof, whereby strap supplied from the strap outlet of the channel is capturable by one of the plurality of strap inlet passages and deflected into the strap chute portion.

14 Claims, 3 Drawing Sheets

BALING AND STRAPPING MACHINE WITH STRAP CAPTURING AND DEFLECTION APPARATUS AND METHOD THEREFOR

BACKGROUND OF THE INVENTION

The invention relates generally to machines for baling and strapping compressible materials to form a packaged load, and more particularly to methods and apparatuses for capturing and deflecting strap into strap chute portions that direct strap about a load during strap feeding operations in baling and strapping machines.

Compressible materials, including cardboard and cotton among many others, are often packaged for shipping and handling in baling and strapping machines, which form the material into a compressed bale, or load, and then apply several strapping members thereabout to provide a securely packaged load. U.S. Pat. No. 4,438,689, for example, discloses a material baling and strapping machine having a press assembly including a hydraulic ram, which moves a lower platen relative to a fixed upper platen to compact a compressible material disposed therebetween to form the load. This configuration is thus sometimes referred to as an up-packing press. A power strap feeding assembly located on a side portion of the bale feeds strap through a channel in the upper platen across a top portion of the bale and into a curved chute portion located along an opposing side portion of the bale. The curved chute extends between the top and bottom portions of the bale, and directs the strap downwardly along the opposing side portion and into a channel in the lower platen, wherein the strap is fed back across the bottom portion of the bale toward the side on which the power strap feed assembly is located. The strap is accordingly disposed in a loop about the bale, tensioned, and overlapping portions thereof are joined by means known in the art. U.S. Pat. No. 4,438,689 also discloses an inlet of the curved chute defined by outwardly flared side wall portions and an outwardly flared face portion to funnel the strap into the curved chute as the strap bridges a gap between the channel of the upper platen and the curved chute, thereby compensating for alignment variation therebetween. But since the upper platen is fixed relative to the inlet of the curved chute, there is relatively little difficulty feeding the strap from the channel in the upper platen into the curved chute.

Baling and strapping apparatuses having up-packing presses, including U.S. Pat. No. 4,438,689, are more likely susceptible to misfeeding the strap between the portions of the chute and the channel through the movable lower platen. More particularly, the position of the movable lower platen generally varies over some range after formation of the bale. The range is dependent usually on the quantity and compressibility of the material loaded into the press, and may be several inches more or less. Since the press must generally maintain pressure on the bale until it is secured by the strap, the alignment between the channel through the movable lower platen and the inlet to the curved chute also varies over approximately the same range during the strap feeding process. Thus the strap is frequently misfed from the curved chute to the channel in the variably positioned lower platen. Similarly, the strap may misfeed as it passes from the channel of the lower platen into a return chute portion directing the strap back toward the power strap feeding assembly. Misfed strap adversely effects system reliability and productivity.

The present invention is drawn to advancements in the art of feeding strap through a chute about a bale in a baling and strapping machine.

It is thus an object of the invention to provide novel methods and apparatuses for capturing and deflecting strap applied about a load in baling and strapping machines, and combinations thereof, that overcome problems in the prior art, and that are economical and reliable.

It is a more particular object of the invention to provide novel methods and apparatuses for capturing and deflecting strap applied about a load in baling and strapping machines having a strap chute portion, a movable platen with a range of variable positioning, a channel with a strap outlet disposed through the movable platen, wherein the channel is generally non-parallel to the strap chute portion. The apparatus includes generally a plurality of at least two strap inlet passages, each strap inlet passage having a strap entry and a strap exit, and a common strap outlet passage having a strap exit coupled to the strap chute portion, wherein the strap exit of each strap inlet passage is coupled to the strap outlet passage. The plurality of strap inlet passages are arranged at an angle relative to the channel and adjacent the movable platen along the range of variable positioning thereof, whereby strap supplied from the strap outlet of the channel is capturable by one of the plurality of strap inlet passages and deflected into the strap chute portion.

It is also an object of the invention to provide novel methods and apparatuses for capturing and deflecting strap applied about a load as discussed generally above wherein the strap outlet passage of the apparatus is arranged substantially perpendicular to the channel through the movable platen, and the strap inlet passages are arranged at substantially equal angles relative to the channel and relative to the strap outlet passage, whereby strap captured by one of the plurality of strap inlet passages is deflected by the bottom wall portion thereof and into the strap outlet passage toward the strap chute portion.

It is another object of the invention to provide novel methods and apparatuses for capturing and deflecting strap applied about a load as discussed generally above wherein the top wall portion of each strap inlet passage is defined by first and second pivotal gates, which are pivotable away from each other to release strap disposed in one of the strap inlet passages during strap tensioning.

It is a further object of the invention to provide novel methods and apparatuses for capturing and deflecting strap applied about a load as discussed generally above wherein the bottom wall portion of the strap inlet passages includes an upwardly directed lip, which further deflects the strap into the strap outlet passage.

It is a yet another object of the invention to provide novel methods and apparatuses for capturing and deflecting strap applied about a load in baling and strapping machines wherein the first and second gates have corresponding flanges biased toward the outer sides of the corresponding first and second side walls of a body member to configure the first and second gates to form the top and bottom surfaces of the strap inlet passages, whereby the first and second gates are pivotal away from each other against the bias of the spring members to release the strap during tensioning.

These and other objects, features, aspects and advantages of the present invention will become more fully apparent upon careful consideration of the following Detailed Description of the Invention and the accompanying Drawings, which may be disproportionate for ease of understanding, wherein like structure and steps are referenced by corresponding numerals and indicators.

DETAILED DESCRIPTION OF THE INVENTION

Figure 1:
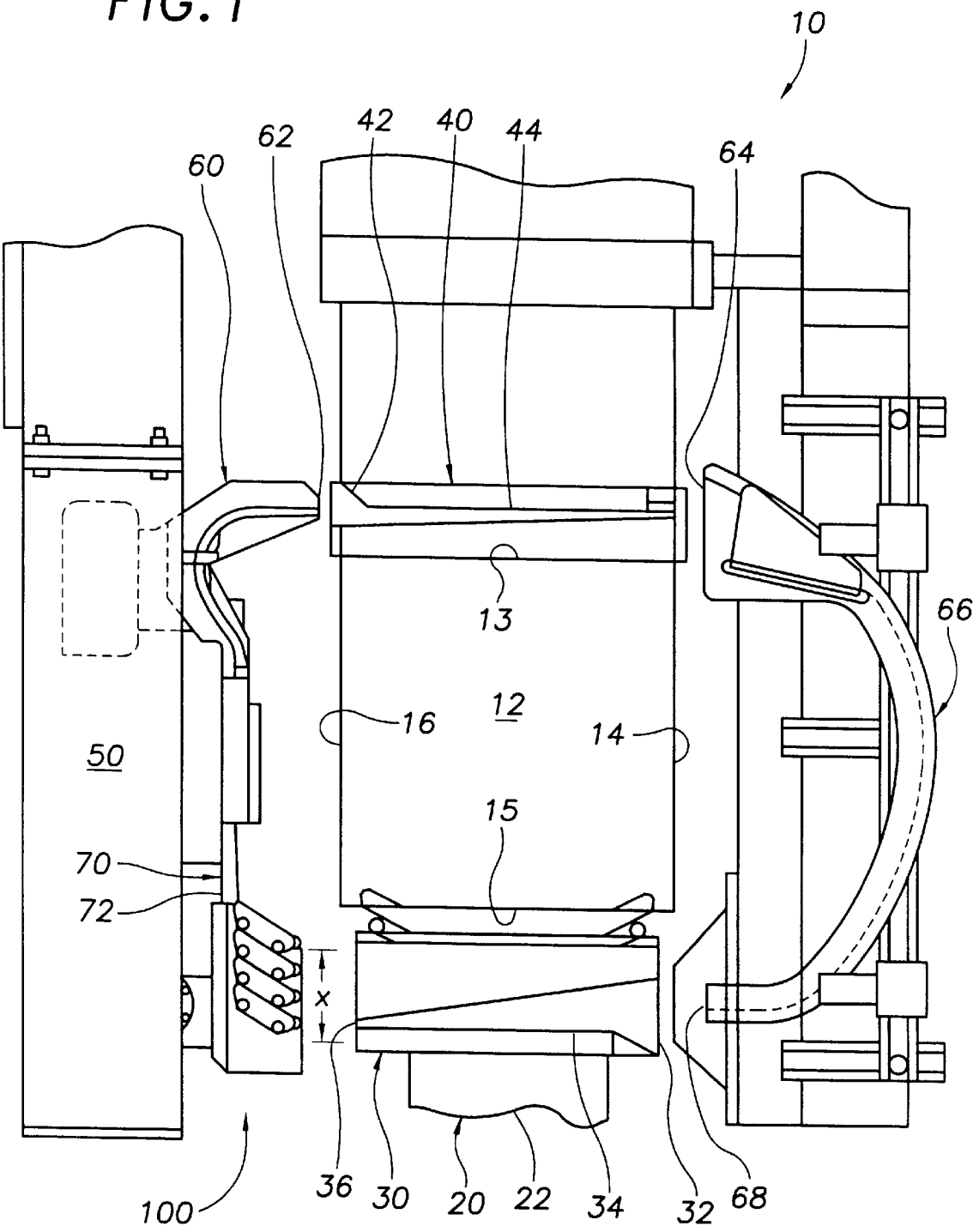
FIG. 1 is a partial elevational view of a machine for baling and strapping compressible materials according to the present invention.

FIG. 1 is a baling and strapping machine 10 comprising generally a press 20 with a hydraulic ram 22 for driving a movable lower platen 30 relative to a fixed upper platen 40 to compress a compressible material disposed in the press 20 between the lower and upper platens 30 and 40 into a bale, or load 12. In other machines the upper platen is movable relative to the lower platen. The movable platen must generally maintain pressure on the load 12 while strapping is applied thereabout as discussed above and further below. Thus upon compressing the load, the movable platen has a range of variable positioning, indicated as $\chi$ in FIG. 1, which is dependent on the quantity and compressibility of the material disposed in the press.

The machine 10 also includes at least one strap feeding and joining apparatus 50 for feeding strap through one or more strap chute portions about the load 12. In the exemplary embodiment, the strap, not shown, is fed initially through a first strap chute portion 60 and exits from an outlet 62 thereof toward and into an enlarged opening 42 in an upper channel 44 through the fixed upper platen 40. The strap is thus fed from the first chute portion 60, across a top portion 13 of the bale 12, and then into an enlarged inlet 64 of a curved chute portion 66, which directs the strap downwardly along a side portion 14 of the bale 12. The strap is fed from an outlet 68 of the curved chute portion 66 toward and into an enlarged opening 32 in a lower channel 34 through the movable lower platen 30, wherein the strap is fed back across a bottom portion 15 of the bale 12. The strap is then fed from an outlet 36 of the lower channel 34 into a strap capturing and deflecting apparatus 100, which ultimately directs the strap into a return chute portion 70 upwardly along a side portion 16 of the bale 12 back toward the strap feeding and joining apparatus 50.

In FIG. 1, the strap capturing and deflecting apparatus 100 is coupled to a strap inlet 72 of the return chute portion 70 and is disposed adjacent the outlet 36 of the lower channel 34 to compensate for the variable positioning of the movable lower platen 30, thereby substantially eliminating strap misfeeds as discussed further below. The return chute portion 70 is substantially perpendicular to the lower channel 34, but the channel 34 through the movable platen 30 is more generally non-parallel to the strap chute portion 70. Also, while the exemplary embodiment shows the apparatus located between the movable lower platen 30 and the strap return chute portion 70, the apparatus 100 is more generally coupled to any strap inlet of any strap chute portion and located adjacent to a corresponding strap outlet of a strap feed channel along the range of variable positioning thereof.

Figure 2:
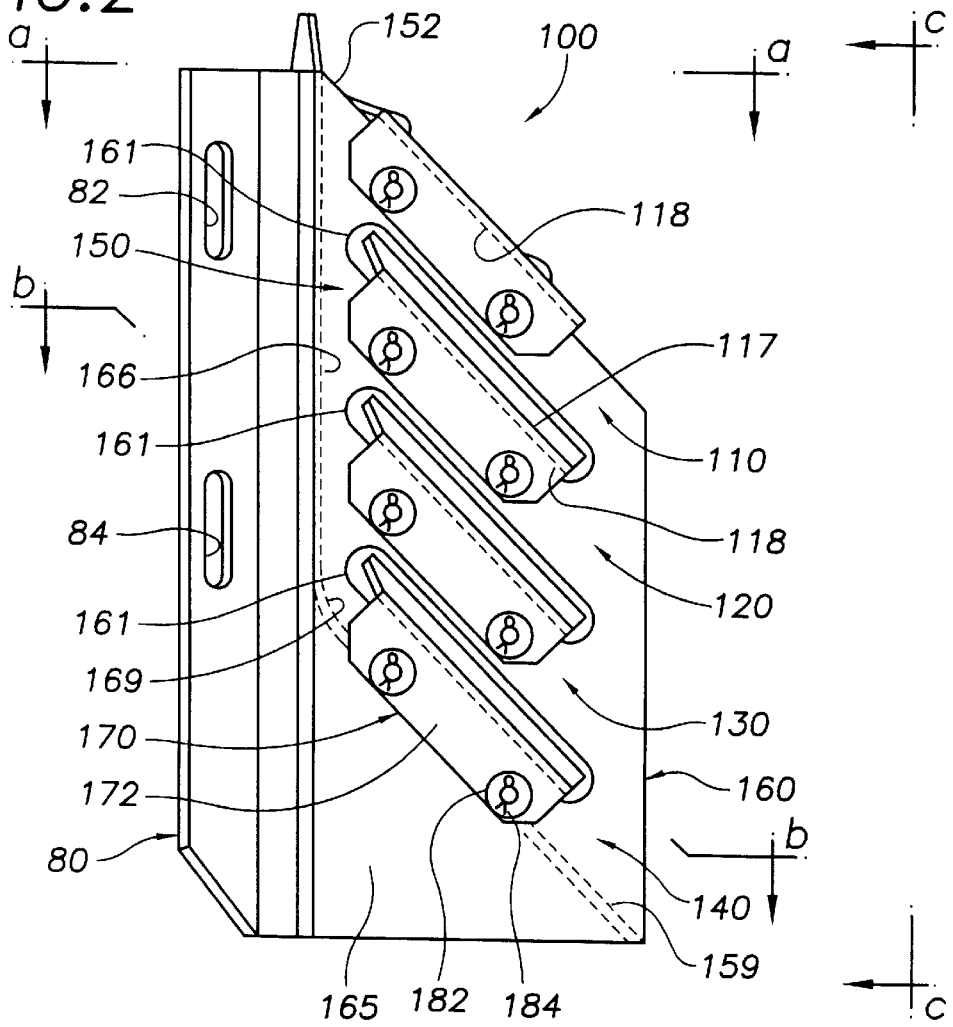
FIG. 2 is an enlarged side elevational view of an apparatus for capturing and deflecting a strap fed from a channel through a platen and into a chute portion.
Figure 3B:
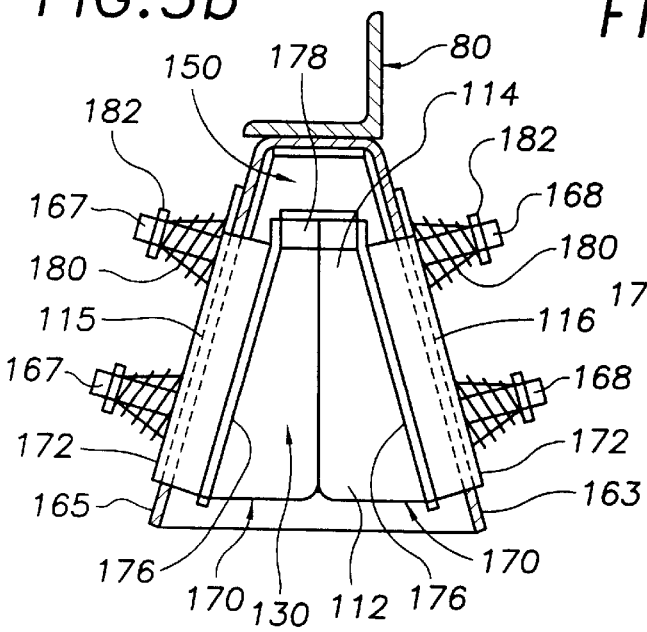
FIG. 3*b* is a sectional view along lines b—b of FIG. 2.
Figure 3A:
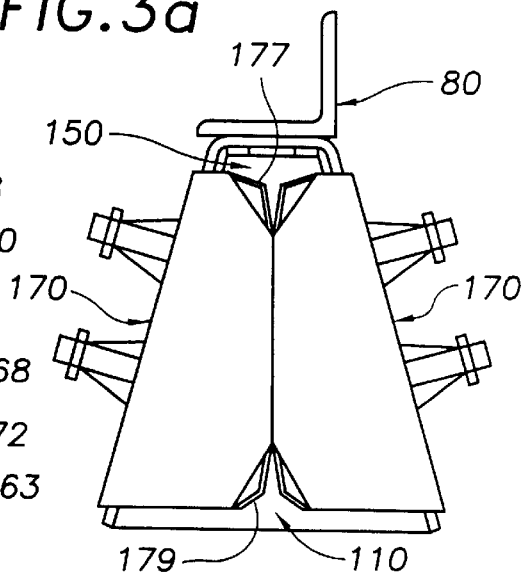
FIG. 3*a* is a top plan view along lines a—a of FIG. 2.

In FIGS. 1 and 2, the apparatus 100 includes four strap inlet passages 110, 120, 130 and 140 coupled to a common strap outlet passage 150. More generally the apparatus 100 may include more or less strap inlet passages. FIG. 3*b* shows each strap inlet passage including a corresponding strap entry 112 and a corresponding strap exit 114 coupled to the common strap outlet passage 150. The strap outlet passage 150 includes a strap exit 152 coupled to a strap chute portion, which in the exemplary embodiment of FIG. 1 is the inlet 72 of the strap chute return 70. The plurality of strap inlet passages are arranged substantially parallel to one another and at an angle relative to the channel 34 through the movable platen 30. The plurality of strap inlet passages are also disposed adjacent the movable platen 30 along the extent of the range of variable positioning $\chi$ thereof, whereby strap supplied from the strap outlet 36 of the channel 34 through the movable platen 30 is capturable by one of the plurality of strap inlet passages and deflected into the strap chute portion. FIGS. 1, 2 and 3 show a bracket member 80 with slots 82 and 84 for adjustably but fixedly mounting the apparatus 100 to the baling and strapping machine 10 so that the plurality of strap inlet passages are accurately disposeable adjacent the movable platen 30 along full extent of the range of variable positioning $\chi$ thereof.

Figure 4:
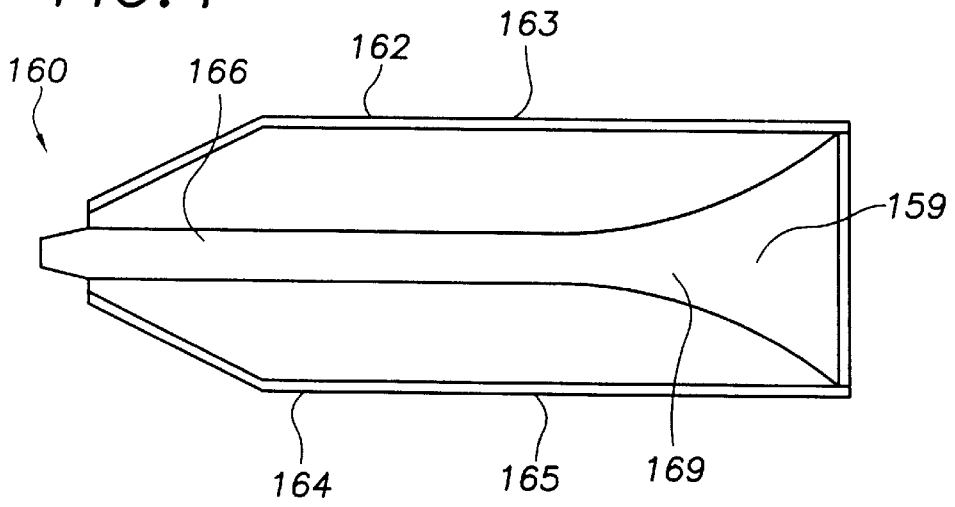
FIG. 4 is a partial end elevational view along lines c—c of FIG. 2.

In FIGS. 1 and 2, the plurality of strap inlet passages 110–140 are each defined partially by corresponding substantially opposing side wall portions 115 and 116 converging from the strap entry 112 to the strap exit 114. FIG. 4 shows the side wall portions 116 formed by a unitary body member 160 having converging side walls 162 and 164 coupled by a common end plate portion 166. The opposing side walls 162 and 164 of the body member 160 are thus common to each of the plurality of strap inlet passages, and an upper portion of the common end plate 166 of the body member 160 partially defines the strap outlet passage 150.

The strap inlet passages are each defined further by a corresponding bottom wall portion and a corresponding substantially opposing top wall portion. In FIG. 2, the strap inlet passage 110 is defined by bottom wall portion 117 and a top wall portion 118. FIGS. 1 and 2 show the plurality of substantially parallel strap inlet passages arranged one on top of the other so that the top wall portion 118 of a lower strap inlet passage forms a bottom wall portion 117 of an adjacent upper strap inlet passage. In FIGS. 1, 2 and 3, the top wall portion 118 of each of the plurality of strap inlet passages are defined by first and second pivotal gates 170, which are mirror images of each other, whereby the first and second gates 170 are pivotable away from each other to release strap disposed in the corresponding strap inlet passage during strap tensioning. The strap is released from the lower and upper channels 34 and 44 through the lower and upper platens 30 and 40 by means known in the art. A lower portion 159 of the end plate 166 forms the bottom wall portion 117 of the strap inlet passage 140.

In FIGS. 1 and 2, the strap outlet passage 150 of the apparatus 100 is arranged substantially 90 degrees relative to the channel 34 through the movable lower platen 30, and the plurality of substantially parallel strap inlet passages of the apparatus 100 are arranged substantially 45 degrees relative to the strap outlet passage 150 and relative to the channel 34 through the movable platen. More generally, however, the plurality of strap inlet passages are arranged at equal angles relative to the channel from which strap is fed and relative to the strap outlet passage 150 to which the strap is directed.

In FIGS. 1, 2, 3, 5 and 6, the first and second gates 170 each have a corresponding flange 172 coupled to an outer side 163 or 165 of a corresponding side wall 162 or 164 of the body member 160. More particularly, each flange 172 includes apertures 174 through which corresponding support members 167 and 168 extend, wherein the flanges 172 are biased toward the outer sides of the corresponding first and second side walls 162 and 164 of the body member 160 by corresponding spring members 180. The spring members 180 ordinarily configure the first and second gates 170 to form the top and bottom wall portions 117 and 118 defining the strap inlet passages as shown. The first and second gates 170 forming the top wall portion 118 of each strap inlet passage are pivotal upwardly and away from each other against the bias of the spring members 180 by the strap during tensioning thereof, thereby releasing the tensioned strap from the apparatus 100.

FIGS. 2 and 3*b* show, more particularly, the flanges 172 of the gates 170 extending through corresponding first and second openings 161 in the first and second side walls 162 and 164 of the body member 160. Only the openings 161 on body member 160 are shown in FIG. 2. In the exemplary embodiment, the spring members 180 are conical coil springs compressed between a corresponding washer member 182 and the flange 172, wherein the washer members 182 are retained on the corresponding support members 167 and 168 by a cotter pin 184, or bolt, or other known means as shown in FIG. 1. According to a related aspect of the invention shown in FIGS. 2, 3*b* and 5, the bottom wall portion 117 of each of the strap inlet passages 110, 120 and 130 includes converging first and second inner side wall portions 176 protruding upwardly therefrom to obstruct passage of strap through the first and second openings 161 through the body member 160.

Figure 5B:
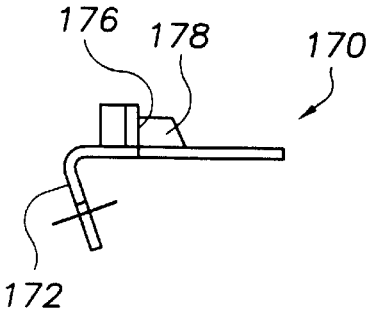
FIG. 5*b* is a front end elevational view of the deflector gate of FIG. 5*a*.
Figure 5A:
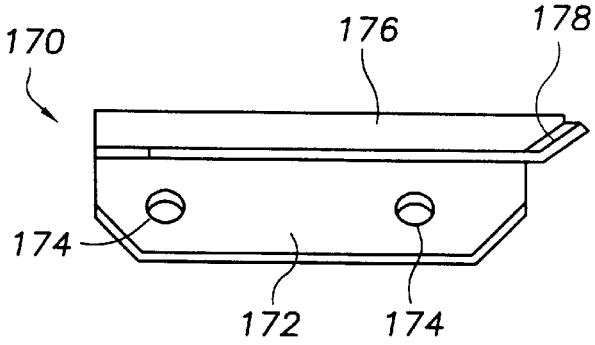
FIG. 5*a* is side elevational view of a deflector gate.
Figure 6A:
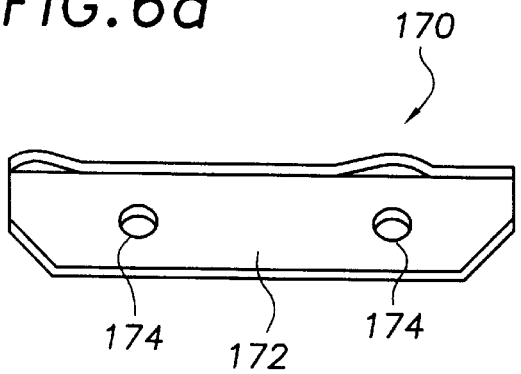
FIG. 6*a* is side elevational view of an upper deflector gate.
Figure 6B:
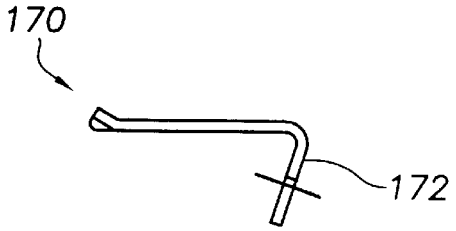
FIG. 6*b* is a front end elevational view of the upper gate of FIG. 6*a*.

FIGS. 3*b* and 5 show the bottom wall portion of strap inlet passages 110, 120 and 130 having an upwardly directed lip 178 located toward the corresponding strap exit of the strap inlet passage, whereby the upwardly directed lip further deflects the strap into the strap outlet passage 150 and toward the strap chute portion 70. FIGS. 1 and 4 show the bottom wall portion 117 of strap inlet passage 140 defined by the lower portion 159 of the end plate 166 having a curved portion 169, which further deflects strap the from the strap inlet passage 140 into the strap outlet passage 150 similar to the lips 178. And FIGS. 1, 3*b* and 6 show the first and second gates 170 of the strap inlet channel 110 having upwardly flared corners 177 and 179 for reducing friction on the strap and facilitating removal of the strap from the strap inlet passage during tensioning of the strap.

Thus as strap is supplied or fed from the channel 34 through the movable lower platen 30, one of the plurality of strap inlet passages 110–140 disposed adjacent the movable platen along the range of variable positioning of the movable platen captures the strap. The strap is then deflected initially by the bottom surface portion 117 of the capturing strap inlet passage upwardly toward and into the strap outlet passage 150. The strap is further deflected upwardly into the strap outlet passage by the lip 178 or by the curved portion 169 of the end plate 166 of the strap inlet passage that captured the strap fed from the channel 34, whereby the strap is ultimately fed from the strap outlet passage into the strap chute portion 70. Upon tensioning the strap, the first and second gates 170 of as many strap inlet passages as are disposed between the strap and the bale 12 are pivoted upwardly and away from each other against the bias of the corresponding spring members 180 to release strap disposed in the strap therefrom.

While the foregoing written description of the invention enables anyone skilled in the art to make and use what is at present considered to be the best mode of the invention, it will be appreciated and understood by anyone skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. An apparatus for capturing and deflecting strap applied about a load in a baling and strapping machine having a strap chute portion, a movable platen with a range of variable positioning, a channel with a strap outlet disposed through the movable platen, the channel is non-parallel to the strap chute portion, the apparatus comprising:

a plurality of at least two strap inlet passages, each strap inlet passage having a strap entry and a strap exit, each strap inlet passage defined by substantially opposing side wall portions converging from the strap entry to the strap exit, and each strap inlet passage defined by a bottom wall portion and a top wall portion;

a strap outlet passage having a strap exit, the strap exit of each strap inlet passage coupled to the strap outlet passage, and the strap exit of the strap outlet passage coupled to the strap chute portion, the plurality of strap inlet passages arranged substantially parallel and at an angle relative to the channel through the movable platen, the plurality of strap inlet passages adjacent the movable platen along the range of variable positioning of the movable platen, whereby strap supplied from the strap outlet of the channel through the movable platen is capturable by one of the plurality of strap inlet passages and deflected into the strap chute portion.

2. The apparatus of claim 1, the strap outlet passage arranged substantially 90 degrees relative to the channel through the movable platen, and the strap inlet passages arranged substantially 45 degrees relative to the channel through the movable platen and to the strap outlet passage, whereby strap captured by one of the plurality of strap inlet passages is deflected by the bottom wall portion of the strap inlet passage and into the strap outlet passage toward the strap chute portion.

3. The apparatus of claim 1, the top wall portion of each of the plurality of strap inlet passages defined by first and second pivotal gates, whereby the first and second gates are pivotable away from each other to release strap disposed in one of the strap inlet passages during strap tensioning.

4. The apparatus of claim 3, the plurality of strap inlet passages arranged one on top of the other, the top wall portion of a lower strap inlet passage forming a bottom wall portion of an adjacent upper strap inlet passage.

5. The apparatus of claim 4, the bottom wall portion of the strap inlet passages having an upwardly directed lip located toward the corresponding strap exit of the strap inlet passage, whereby the upwardly directed lip further deflects the strap into the strap outlet passage.

6. The apparatus of claim 3, the first and second gates having corresponding first and second flanges coupled to outer sides of corresponding first and second side walls of a body member, the first and second flanges biased toward the outer sides of the corresponding first and second side walls of the body member by corresponding spring members, whereby the first and second gates are pivotal away from each other against the bias of the spring members.

7. The apparatus of claim 6, the plurality of substantially parallel strap inlet passages arranged one on top of the other, the top wall portion of a lower strap inlet passage forming a bottom wall portion of an adjacent upper strap inlet passage, the first and second gates of at least one strap inlet passage extending through corresponding first and second openings in the first and second side walls of the body member, and the bottom wall portion of at least one of the strap inlet passages having converging first and second inner side wall portions protruding upwardly from the bottom wall portion to obstruct passage of strap through the first and second openings of the corresponding first and second side walls of the body member.

8. A baling and strapping machine comprising:

a press having a movable platen with a range of variable positioning, and a channel with a strap outlet disposed through the movable platen;

a strap chute portion non-parallel to the channel through the movable platen;

a plurality of at least two strap inlet passages, each strap inlet passage having a strap entry and a strap exit, each strap inlet passage defined by substantially opposing side wall portions converging from the strap entry to the strap exit, and each strap inlet passage defined by a bottom wall portion and a top wall portion;

a strap outlet passage having a strap exit, the strap exit of each strap inlet passage coupled to the strap outlet passage, and the strap exit of the strap outlet passage coupled to the strap chute portion, the plurality of strap inlet passages arranged substantially parallel and at an angle relative to the channel through the movable platen, the plurality of strap inlet passages adjacent the movable platen along the range of variable positioning of the movable platen, whereby strap supplied from the strap outlet of the channel through the movable platen is capturable by one of the plurality of strap inlet passages and deflected into the strap chute portion.

9. The machine of claim 8, the strap outlet passage arranged substantially 90 degrees relative to the channel through the movable platen, and the strap inlet passages arranged substantially 45 degrees relative to the channel through the movable platen and to the strap outlet passage, whereby strap captured by one of the plurality of strap inlet passages is deflected by the bottom wall portion of the strap inlet passage and into the strap outlet passage toward the strap chute portion.

10. The machine of claim 8, the top wall portion of each of the plurality of strap inlet passages defined by first and second pivotal gates, whereby the first and second gates are pivotable away from each other to release strap disposed in the corresponding strap inlet passage during strap tensioning.

11. The machine of claim 8, the movable platen is a lower platen of an up-packing press, and the strap chute portion is a strap return chute.

12. A method for feeding strap about a load in a baling and strapping machine having a strap chute portion with a strap inlet, a movable platen with a range of variable positioning, a channel disposed through the movable platen, the channel is non-parallel to the strap chute portion, the method comprising:

capturing strap fed from a strap outlet of the channel through the movable platen in one of a plurality of at least two substantially parallel strap inlet passages adjacent the movable platen along the range of variable positioning of the movable platen;

deflecting the strap captured by the one of the plurality of strap inlet passages into a strap outlet passage with a bottom surface portion of the strap inlet passage at an angle relative to the channel through the movable platen; and feeding the strap from the strap outlet passage into the strap chute portion.

13. The method of claim 12, each strap inlet passage defined by opposing side wall portions converging from the strap entry to the strap exit, and each strap inlet passage defined by a bottom wall portion and an opposing top wall portion formed by first and second pivotal gates, the method further comprising pivoting the first and second gates are away from each other to release strap disposed in the strap inlet passage during strap tensioning.

14. The method of claim 13, the bottom wall portion of the strap inlet passages having an upwardly directed lip located toward a corresponding strap exit of the strap inlet passage, the method further comprising further deflecting the strap into the strap outlet passage with the upwardly directed lip as strap is fed from the strap inlet passage to the strap outlet passage.

* * * * *